US005826762A

United States Patent [19]

Dellinger

[11] Patent Number: 5,826,762

[45] Date of Patent: Oct. 27, 1998

[54] TOOL SCABBARD

[76] Inventor: Loy J. Dellinger, 7707 Dellinger Rd., Denver, N.C. 28037

[21] Appl. No.: 496,361

[22] Filed: Sep. 5, 1995

[51] Int. Cl.[6] ..... A45F 5/00

[52] U.S. Cl. ..... 224/270; 224/232; 224/249; 224/251; 224/673; 224/678; 224/904; 224/907

[58] Field of Search ..... 224/673, 270, 224/904, 907, 249, 251, 232, 678, 679; 211/70.6, 69, 70.7; 206/373, 372, 379

[56] References Cited

U.S. PATENT DOCUMENTS

| | | | |
|---|---|---|---|
| 2,578,237 | 12/1951 | Geistweit | 224/907 |
| 2,815,863 | 12/1957 | Larson | 211/70.6 |
| 3,236,366 | 2/1966 | Broda et al. | 211/69 |
| 3,343,735 | 9/1967 | Breeding et al. | 224/904 |
| 3,616,976 | 11/1971 | Geretschlaeger | 224/249 |
| 3,978,984 | 9/1976 | Cowley | 211/69 |
| 4,323,181 | 4/1982 | Spasoff | 224/253 |
| 4,460,085 | 7/1984 | Jantzen | 206/373 |
| 4,638,530 | 1/1987 | Perry | 224/904 |
| 5,213,242 | 5/1993 | de Jong | 224/232 |
| 5,232,137 | 8/1993 | Devine | 224/252 |
| 5,288,002 | 2/1994 | Oh | 224/252 |

*Primary Examiner*—Linda J. Sholl
*Attorney, Agent, or Firm*—Clifton Ted Hunt

[57] ABSTRACT

A tool scabbard is provided for supporting a plurality of different tools from a belt encircling a user's waist. The tool scabbard is of rigid construction with an elongated rigid base and a plurality of rigid shelves projecting outwardly from the base and forming an integrated unit or monolithic structure. The shelves have openings to support tools and the shelves are spaced far enough below the top of the scabbard to support sharp tools with their sharp edges below the top of the rigid scabbard for protection of the user.

2 Claims, 1 Drawing Sheet

TOOL SCABBARD

FIELD OF THE INVENTION

This invention relates to holders for tools and more specifically to tool holders that are carried on the person for convenient access when needed.

BACKGROUND OF THE INVENTION

Holders for tools that are supported about the user's waist are well known and have long been used by telephone linesmen, carpenters, and others.

Such holders are formed with pockets and straps that are shaped to support tools needed by the user to perform specific tasks and, to applicant's knowledge, the prior art tool holders that support specific tools about a user's waist are formed from a flexible material, such as leather, and their only function is to provide convenient access to the tools.

SUMMARY OF THE INVENTION

The tool scabbard of the present invention is formed from a rigid material, such as a suitably stiff and sturdy plastic, for the purpose of protecting the user from the sharp edges of tools such as dry wall knives. In the past, workers in the dry wall industry have frequently carried the sharp dry wall knives in their rear pockets and thereby exposed themselves to serious injury.

The applicant's rigid tool scabbard is preferably molded from a suitably stiff and sturdy plastic to define a rigid backing or base that rests against the user's body in use and protects the user from the sharp edges of tools within the scabbard. The base of the scabbard is formed with a recessed area between two openings to receive a belt to be fastened about the user's waist. Flanges or shelves project perpendicularly from the base to support tools.

DETAILED DESCRIPTION OF THE INVENTION

Figure 1:
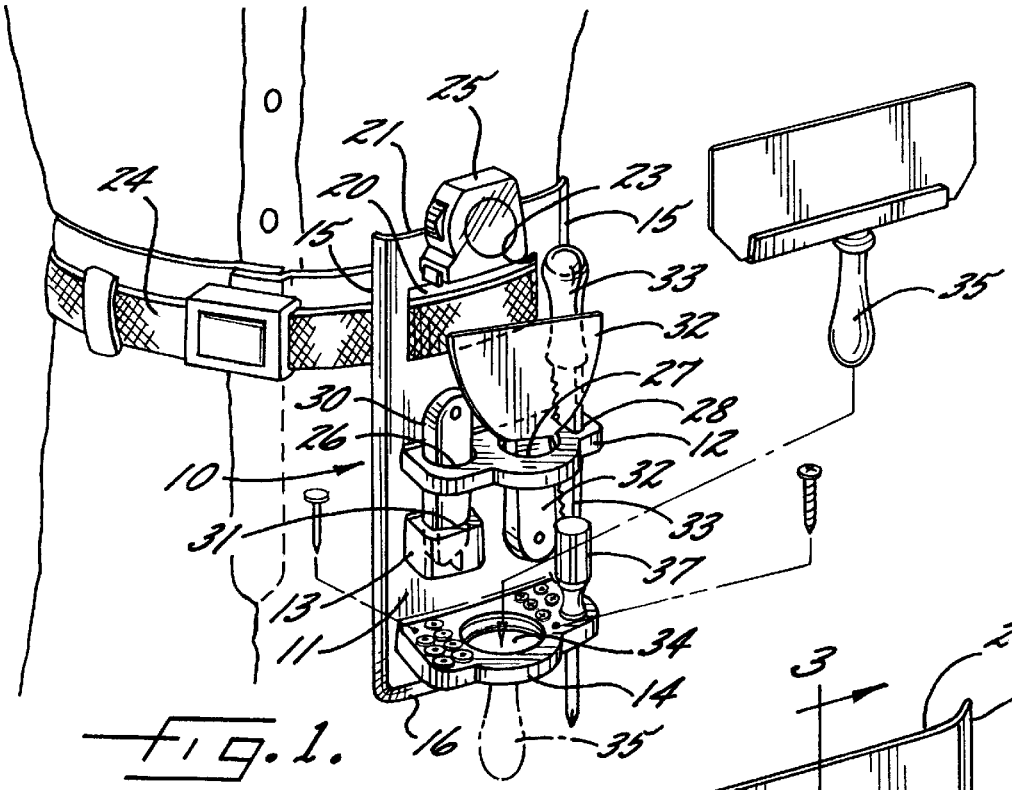
FIG. 1 is a perspective view of the tool scabbard and tools supported on the left side of a left-handed user by a belt encircling the user's waist.
Figure 3:
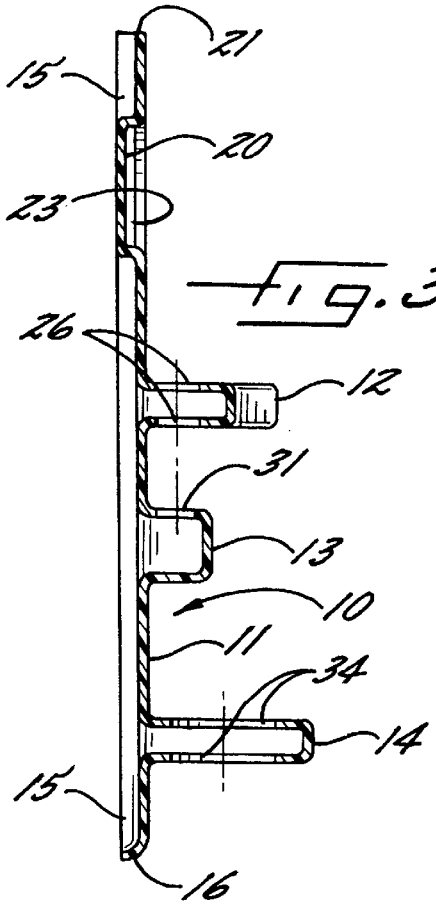
FIG. 3 a sectional view taken substantially along the line 3—3 in FIG. 2.

The tool scabbard, broadly indicated at 10, comprises a rigid sheet, preferably molded from a suitable plastic, that is shaped to define a base 11 with a body portion extending in a given plane and displaced portions that extend inwardly and outwardly relative to the plane of the body portion. The outwardly displaced portions of the base define tool supporting shelves 12, 13, and 14 formed integrally with the base 11. The shelves 12, 13, and 14 project perpendicularly outwardly from the base 11 and in verticaly spaced parallel relation to each other. The base 11 is stiffened by an inwardly turned flange 15 extending across the bottom 16 and along the sides 17, 18 of the base 11.

The base 11 is formed with an inwardly spaced and transversely extending recessed area 20 spaced downwardly from and in parallel relation to the top edge 21 of the base 11, as seen in the drawings. The base 11 is also formed with openings 22 and 23 that extend transversely through the base 11 at the ends of the recessed area 20, and with which the recessed area communicates. As shown in the drawings, the openings 22, 23 are shaped and sized to conform with the width and thickness of a belt 24 that encircles a user's waist to support the scabbard 10 and its tools for easy access when needed. In use, the belt 24 is threaded through the openings 22, 23 and across the recessed area 20, as shown in FIG. 1.

The top edge 21 of the base 11 is spaced a sufficient distance above the recessed area 20 to receive a standard tape measure (illustrated at 25) of the type having a clip on the back of the housing that is normally intended for attachment to the belt of a user. According to the present invention, the clip on the back of the tape measure is attached to the top edge 21 of the base and the tape measure 25 is carried by the base 11 above the user's belt 24.

The shelves 12, 13, and 14 each have vertically extending openings as shown in the drawings. The openings in the shelves have different shapes to accomodate different tools that are supported by the scabbard.

Figure 2:
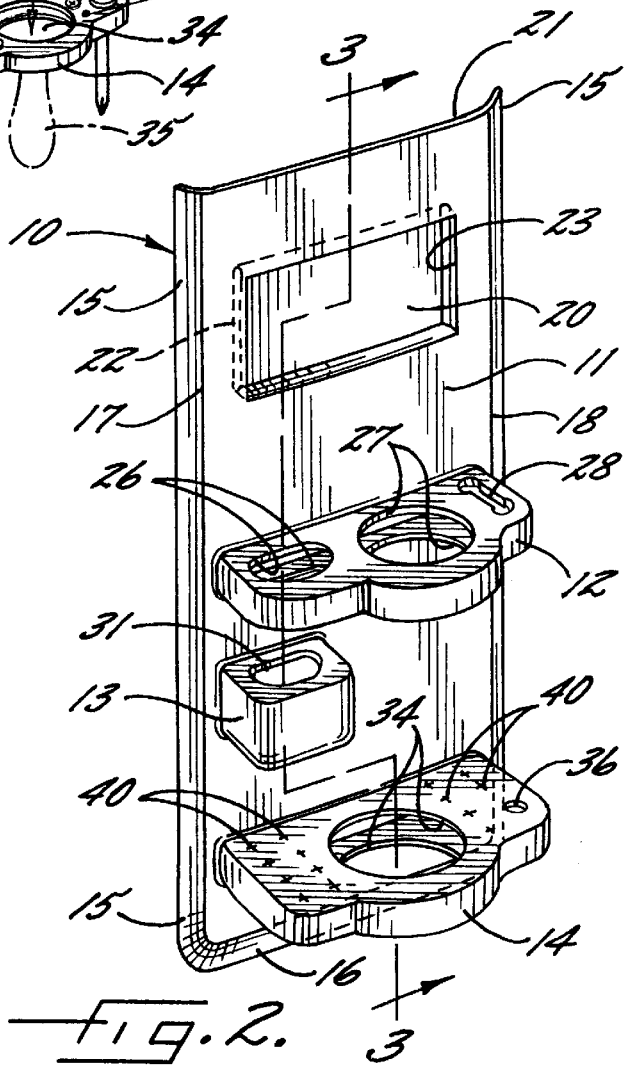
FIG. 2 is a perspective view of the tool scabbard that is similar to FIG. 1, but showing the tool scabbard removed from the user and from the supporting belt, and omitting the tools shown in FIG. 1.

More specifically, the shelf 12 has three openings, 26, 27, and 28 extending completely through the shelf (FIG. 2). Referring to FIG. 1, it is seen that the opening 26 through shelf 12 supports the handle of a utility knife 30. The blade of the utility knife is seated in a pocket formed by an opening 31 in only the upper portion of shelf 13, the bottom portion of shelf 13 being closed. Opening 27 in the center of shelf 12 receives the handle of a dry wall knife 32. The blade of the knife 32 is supported by the shelf 12. Opening 28 through shelf 12 is illustrated in FIG. 1 as containing a keyhole saw 33, with the handle of the saw resting on the shelf 12.

A large opening 34 extends through the center of shelf 14 and the handle of a trowel 35 is shown in FIG. 1 to be positioned in the opening 34, with the blade of the trowel resting on the shelf 14. A smaller opening 36 extends through the shelf 14 near the side 18 of the scabbard. The blade of a screwdriver 37 is shown in FIG. 1 to extend through the opening 36 with the handle of the screwdriver supported on the shelf 14. The shelf 14 has a plurality of small holes 40 which may be filled with a like number of nails and/or screws, as indicated at 41 in FIG. 1.

It is to be understood that it is within the spirit of the invention to modify the shapes of the openings to support different tools and accessories as required by workmen in the performance of different tasks.

The rigidity of the scabbard and the positioning of sharp tools on the shelves with their sharp edges below the top edge of the rigid base protects the user from the risk of being accidentally injured by sharp tools, such as dry wall knives. At the same time, the tools are conveniently positioned for ready access and storage by the user, as needed.

There is thus provided a tool scabbard specifically designed for the safe and efficient handling of tools. Although specific terms have been used in describing the invention, they have been used in a generic and descriptive sense only and not for the purpose of limitation.

I claim:

1. A tool scabbard to depend in a substantially vertical plane from a workman's belt and configured to carry for easy accessibility the variety of tools a workman routinely uses, the tool scabbard comprising a rigid base with an inner surface, an outer surface, a top edge, a bottom edge and opposed side edges and a stiffening flange extending around the edges of the base below the top edge, wherein the improvement comprises:

(a) the base including a body portion with displaced portions of the base that extend inwardly and outwardly relative to the plane of the body portion, (b) one displaced portion of the base extending inwardly and transversely across the body portion in downwardly spaced relation to the upper edge of the base, (c) the base having transversely spaced openings at opposite ends of the inwardly displaced portion of the base to receive a workman's belt threaded through the openings and extending across the inwardly displaced portion of the base, (d) a plurality of the displaced portions of the base extending outwardly and transversely across the body portion and in downwardly spaced relation to the inwardly displaced portion of the base, (i) each of the said plurality of outwardly displaced portions of the base including an upper wall and a lower wall and (ii) at least some of the upper walls and lower walls having openings in registry with each other, whereby selected tools may extend through registered openings for support.

2. The tool scabbard of claim 1 wherein the top edge of the rigid base is spaced sufficiently above the inwardly displaced portion of the base to support a tape measure clipped over the top edge of the rigid base.

* * * * *